US006155269A

United States Patent [19]

Franke et al.

[11] Patent Number: 6,155,269

[45] Date of Patent: Dec. 5, 2000

[54] METHOD FOR REGULATING THE OUTPUT HUMIDITY OF TOBACCO

[75] Inventors: Dietmar Franke; Fritz Schelhorn, both of Bayreuth; Hans-Werner Fuchs, Thurnau; Harald Hofmann, Hummeltal, all of Germany

[73] Assignee: Brown & Williamson Tobacco Corporation, Louisville, Ky.

[21] Appl. No.: 09/188,854

[22] Filed: Nov. 9, 1998

[30] Foreign Application Priority Data

Nov. 20, 1997 [DE] Germany ..... 197 51 525

[51] Int. Cl.[7] ..... A24B 3/02

[52] U.S. Cl. ..... 131/303; 131/300; 131/302; 131/304; 131/305

[58] Field of Search ..... 131/300, 302, 131/303, 304, 305

[56] References Cited

U.S. PATENT DOCUMENTS

| | | | |
|---|---|---|---|
| 3,429,317 | 2/1969 | Koch et al. | 131/305 |
| 3,731,286 | 5/1973 | Graalmann et al. | 131/305 |
| 3,760,816 | 9/1973 | Wochnowski | 131/305 |
| 3,785,765 | 1/1974 | Rowell et al. . | |
| 3,905,123 | 9/1975 | Fowler et al. . | |
| 3,948,277 | 4/1976 | Wochnowski et al. . | |
| 4,045,657 | 8/1977 | Falke . | |
| 4,513,759 | 4/1985 | Wochnowski et al. . | |
| 4,640,299 | 2/1987 | Ono et al. . | |
| 4,730,627 | 3/1988 | Burcham, Jr. et al. . | |

FOREIGN PATENT DOCUMENTS

| | | | |
|---|---|---|---|
| 0095866A1 | 12/1983 | European Pat. Off. . | |
| 0135281A2 | 3/1985 | European Pat. Off. . | |
| 2 406 791 | 10/1977 | France . | |
| 1 813 620 | 8/1970 | Germany . | |
| 2135637 | 2/1973 | Germany | 131/305 |
| WO 90/13231 | 11/1990 | WIPO . | |

*Primary Examiner*—James Derrington
*Attorney, Agent, or Firm*—John F. Salazar; Middleton & Reutlinger

[57] ABSTRACT

The invention relates to a method and device for regulating the output moisture content of tobacco conditioned by a loosening/conditioning and optionally casing (saucing) drum comprising injecting a throughflow of water into the infeed region of the drum by a first nozzle regulated depending on the target value for the tobacco output moisture content and the actual values for the tobacco mass flow, the steam throughflow and the tobacco input moisture content; and injecting a throughflow of water in the outlet region of the drum through a second nozzle, the target value of which is computed depending on the target value and actual value for the tobacco output moisture content.

13 Claims, 3 Drawing Sheets

METHOD FOR REGULATING THE OUTPUT HUMIDITY OF TOBACCO

BACKGROUND OF THE INVENTION

1. Field of the Invention

The invention relates to a method and device for regulating/controlling the output moisture content of tobacco conditioned by a loosening/conditioning and optionally casing (saucing) drum.

2. Description of the Related Art

It is in the tobacco industry, especially in the cigarette industry, that a loosening/conditioning and optionally loosening/conditioning/casing (saucing) drum has the function of loosening the raw tobacco furnished in bales, casing it (also called saucing so that hereinafter casing (saucing) is used) and conditioning it for further steps in the process of preparing the tobacco. Special embodiments of such drums are known, for example, from WO 90/13231, EP-B-0 424 501 and EP-A-0 471 513.

In such a drum, water and/or steam is injected into the tobacco mass contained in the drum, which is supplied to the drum in the form of bales or bale pieces.

A typical embodiment is evident from FIG. 5 of EP-A-0 471 513 wherein the water nozzles are located in the infeed region of the drum and are configured as duplex nozzles introducing a mixture of water and steam. The intention is that the tobacco leaving the drum has an output moisture content of approx. 12% to approx. 16.5%, the precise value depending on the subsequent steps in the method of preparing the tobacco.

Experience has shown that the optimum target value necessary in each case fails to be attained by these known methods, thus resulting in fluctuations in the output moisture content of the tobacco and corresponding problems in subsequent steps in the method of preparing the tobacco.

SUMMARY OF THE INVENTION

The invention is thus based on the object of providing a method and device in which the aforementioned disadvantages do not occur and in which, more particularly, the output moisture content of the tobacco may be regulated/controlled to an optimum value.

This object is achieved in accordance with the invention by a method for regulating the output moisture content of tobacco conditioned by a loosening/conditioning and optionally a casing (saucing) drum 28, comprising injecting into the infeed region of the drum through a first nozzle a throughflow of water regulated depending on the target value for the output moisture content of the tobacco and the actual set values for the tobacco mass flow, the steam throughflow and the input moisture content of the tobacco; and injecting into the outlet region of the drum through a second nozzle a throughflow of water, the target value of which is computed depending on the target value and actual value for the output moisture content of the tobacco; and wherein the discharge hood of said drum is heated by a steam heat exchanger.

Expedient embodiments read from the corresponding sub-claims.

The advantages achieved by the invention are rooted in employing a two-stage infeed of water, namely, for one thing, in the in feed region of the drum and, for another, in the outlet region. The target value for the throughflow of water in the infeed region of the drum is calculated, i.e. dependent on the target value for the output moisture content of the tobacco which in turn depends on the subsequent steps in the method, and on the actual values of the tobacco mass flow, input moisture content of the tobacco and steam throughflow applied to the drum.

In the infeed region of the drum a throughflow of water is thus employed tailored to the method which, however, is yet to be rendered strictly conform with the target value for the output moisture content of the tobacco, this later being exactly set by means of a second water infeed into the outlet region of the drum by calculating the target value of this second water infeed from the target value and actual value for the output moisture content of the tobacco. It is not until the second stage that finalizing the regulation of the output moisture content of the tobacco is fine "tuned" so that a value is attained with high accuracy which is optimum for subsequent steps in the method of preparing the tobacco.

In one preferred embodiment the throughflow of water for water supply in the outlet region of the drum is fine tuned by comparing it to the actual value of the injected flow of water to assure minimum departures from the target value for the output moisture content of the tobacco.

Since the casing (sauce) likewise supplied to the drum contains water, i.e. up to 90% in extreme cases, the target value for the throughflow of the casing (sauce) applied to the drum is taken into account in a preferred embodiment when calculating the throughflow of water for the infeed region of the drum so as avoid heavy departures or fluctuations in this respect, too.

As it reads, calculating the throughflow of water for the infeed region of the drum is done by a formula which takes into account the salient influencing parameters, namely the target value for the output moisture content of the tobacco, the actual value for tobacco mass flow, the actual value for the input moisture content of the tobacco, the actual value for the steam throughflow and in conclusion, where needed, also the target value for the casing (sauce) throughflow.

It has been discovered to be important that the tobacco mass flow supplied to the drum should be maintained constant to assure in this respect consistent and homogenous conditions in the method. It is for this reason that the tobacco mass flow supplied to the drum is regulated by means of a weighing belt disposed between the drum and a slicer upstream of the drum, this slicer being used to apportion the tobacco in slices, whereby the cutting frequency of the slicer is dictated by the weighing belt so that a constant tobacco mass flow is supplied to the drum with high consistency.

In accordance with one advantageous aspect there is provided between the slicer and the weighing belt a first photoelectric barrier located at the start of the impact belt and activating the slicer when receiving a "no slice" alert. To ensure a continuous supply of tobacco bale portions to the weighing belt any gaps in supply are "seen" by a second photoelectric barrier at the end of the impact belt when a "no slice" alert is received, these gaps being closed by elevating the speed of the impact belt to thus also contribute towards a constant tobacco mass flow.

In accordance with one preferred embodiment the two nozzles are configured as duplex nozzles injecting a duplex mixture of water and steam. Both the steam flow supplied and the water flow supplied are detected and tuned to the corresponding target values so that here too heavy fluctuations are practically eliminated.

The casing (sauce) infeed too is engineered by means of a duplex casing/steam nozzle arranged in the outlet region of the drum.

For regulating the temperature of the drum, steam is fed into a recirculating air passage of the drum, this steam flow too being regulated/controlled and taken into account in regulating/controlling the output moisture content of the tobacco.

It has been discovered to be expedient when the discharge hood of the drum is indirectly heated by steam heat exchangers so that in this respect no deposits and more particularly no condensation can materialize, thus ensuring consistent conditions in the method. The door of the discharge hood is electrically heated to avoid condensation and deposits.

In accordance with another preferred embodiment the drum is provided with an "pneumatic blade" which scrapes soilage from the surface of the drum which could otherwise result in random conditions in the method and more particularly in heavy fluctuations in heat transfer.

BRIEF DESCRIPTION OF THE DRAWINGS

The invention will now be detailed on the basis of an example embodiment with reference to the accompanying schematic drawings in which.

DESCRIPTION OF THE PREFERRED EMBODIMENTS

Figure 1:
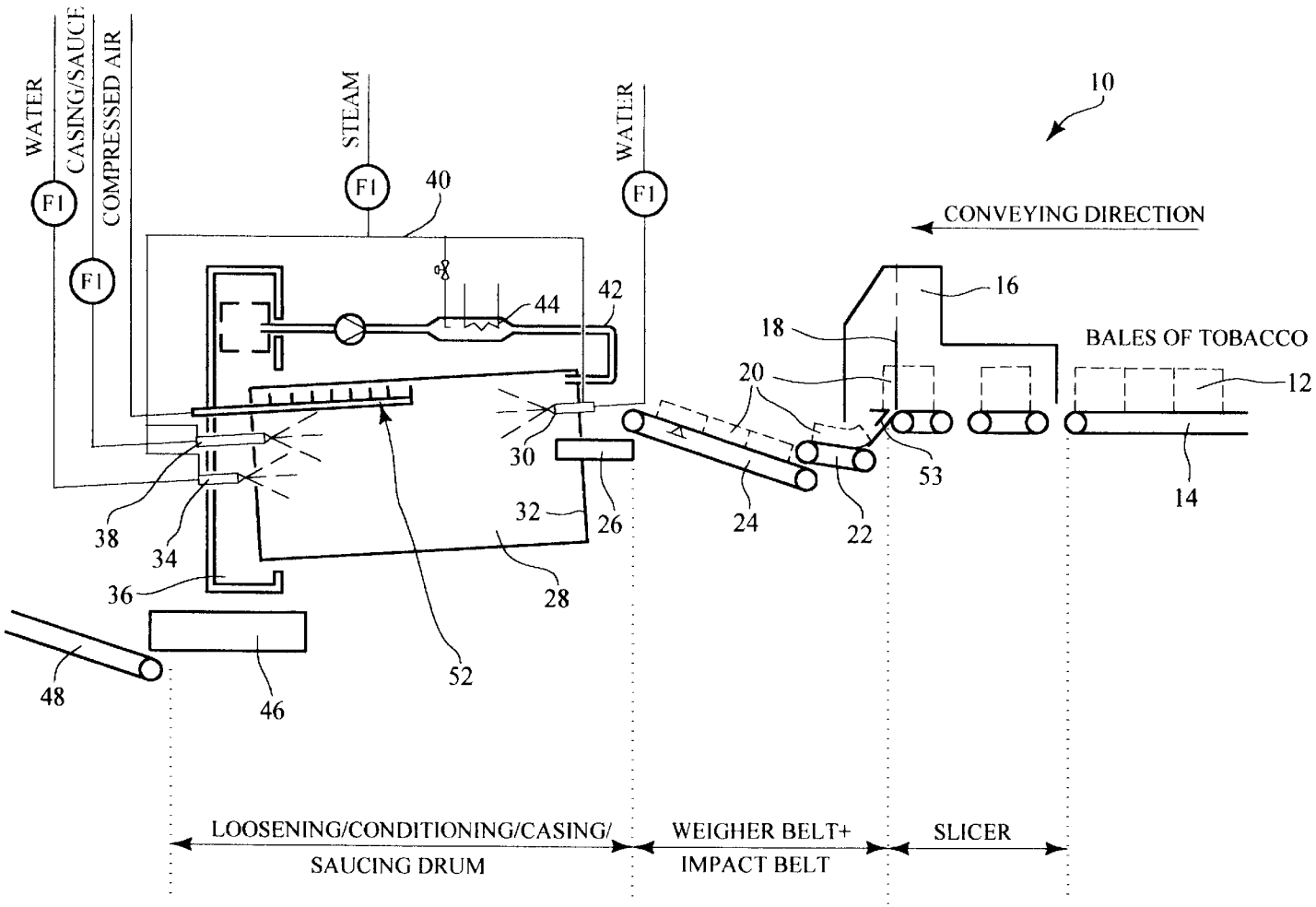
FIG. 1 is a schematic overview of the system.
Figure 2:
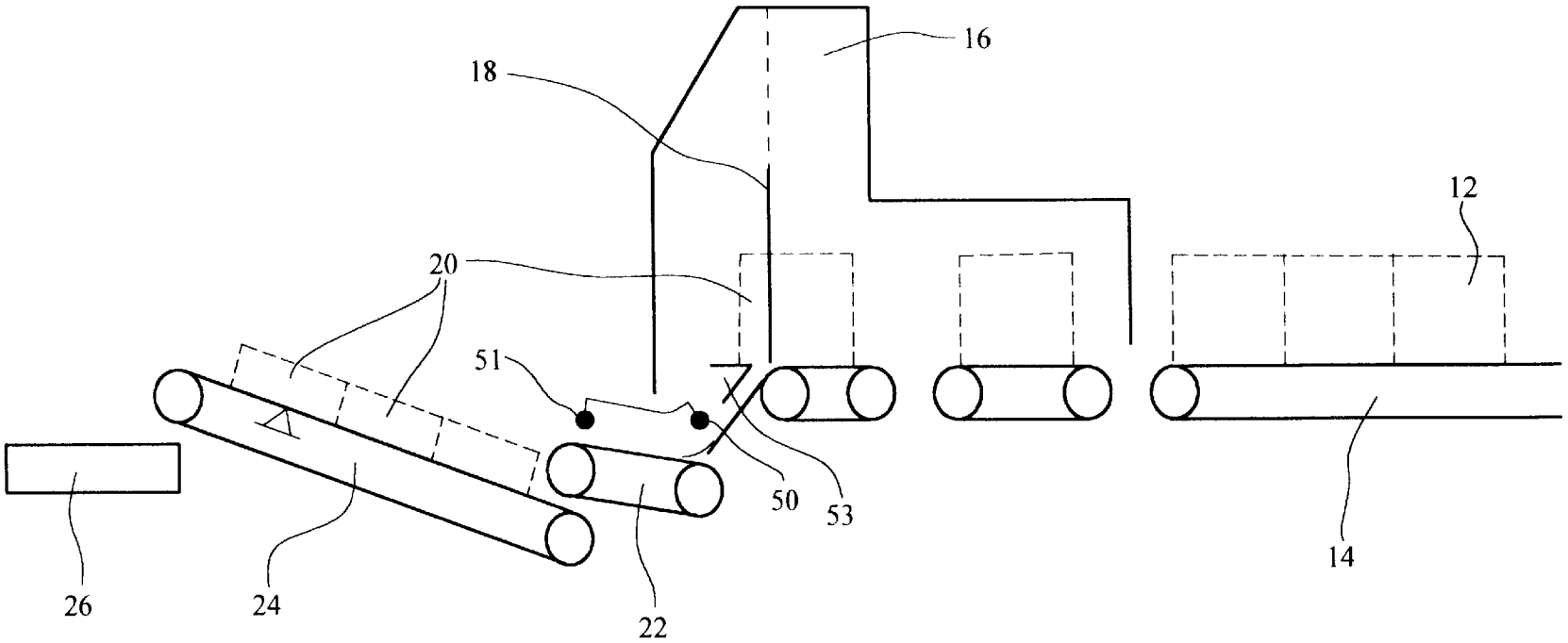
FIG. 2 is a detailed view of the slicer for the tobacco bales and the subsequent weighing belt.

Referring now to FIGS. 1 and 2 the system is illustrated as identified in general by the reference numeral 10, it serving to condition the raw tobacco furnished in the form of tobacco bales 12 for further steps in the process of preparing the tobacco and comprising, as viewed in the conveying direction of the tobacco bales 12, firstly a conveyor belt 14 on which the individual tobacco bales 12 are located in sequence, already stripped of their packaging. The conveyor belt 14 transports the tobacco bales 12 to a cutting device 16 known as a slicer in the tobacco industry in which the tobacco bales 12 are apportioned into slices by a vertically moving cutting knife 18. The cut-off front sliced or cubed portions 20 of each tobacco bale 12 drop onto an impact belt 22 which brings the tobacco slice 20 to a weighing belt 24 which establishes from the weight of the tobacco slice and the belt speed the tobacco mass flow in kg per hour so that the momentary tobacco mass flow value is obtained for each cut-off tobacco slice 20.

From the weighing belt 24 the tobacco slice 20 gains access to an infeed trough 26 for a rotating loosening/conditioning—and optionally casing (saucing)—drum 28 comprising a duplex nozzle 30 located in the infeed region of the drum 28, i.e. in the embodiment as shown in the input face wall 32 of the drum 28, receiving water and steam, whereby the injected flow of water is set so that the tobacco is loosened and conditioned to be transportable.

A further duplex nozzle 34 is located in the discharge hood 36 of the drum 28, it likewise spraying a mixture of water and vehicle steam onto the loosened tobacco particles discharged from the drum 28.

The water flow injected at the output is intended to guarantee a consistent output moisture content of the tobacco as supplied to further processing.

Adjacent to the duplex nozzle 34 for water and vehicle steam a further nozzle 38 is included in the discharge hood 36 of the drum 28 for injecting casing (sauce) and steam, employed should the drum 28 also be intended to serve as a casing (saucing) drum. It is evident that the three nozzles 30, 34 and 38 receive steam from a common conduit 40 connecting the nozzles.

In addition, the drum comprises a recirculating air passage 42 into which likewise steam is injected from the conduit 40 for setting the temperature of the drum.

Installed on the discharge hood 36 is a hood heating fixture configured as a steam heat exchanger to prevent condensation of casing (sauce) and water on the discharge hood 36.

Provided in the discharge hood 36 is a door which is heated for the same reasons, this heating being done electrically.

A steam heat exchanger 44, indicated schematically, is provided in the recirculating air passage 42 serving to preheat the drum.

Provided in the upper region of the drum is an "pneumatic blade", namely a tube 52 provided with outlet nozzles fed with compressed air. The compressed air ejected from the nozzles cyclically, roughly every three minutes, release soilage from the inner wall of the drum 28 so that no sauce or tobacco deposits can materialize. Since the drum is rotated, the complete cylindrical inner surface area of the drum in the region of the discharge end is cleaned so that no soilage can materialize there.

Starting from its infeed region, the drum 28 is inclined obliquely downwards so that the loosened, conditioned and optionally cased (sauced) tobacco is able to fall onto a discharge chute 46 which supplies the tobacco to a conveyor belt 48 and thus to further steps in the process of preparing tobacco.

In the system 10 six process parameters are regulated/controlled, namely, for one, the tobacco mass flow, expressed in kg per hour, for another, the tobacco moisture content express in %, the circulating air temperature of the drum, expressed in ° C., and in conclusion when casing (sauce) is injected, also the casing (sauce) throughflow, expressed in kg per hour, the steam expressed in ° C. and the casing (sauce) pressure, expressed in bar.

Figure 3:
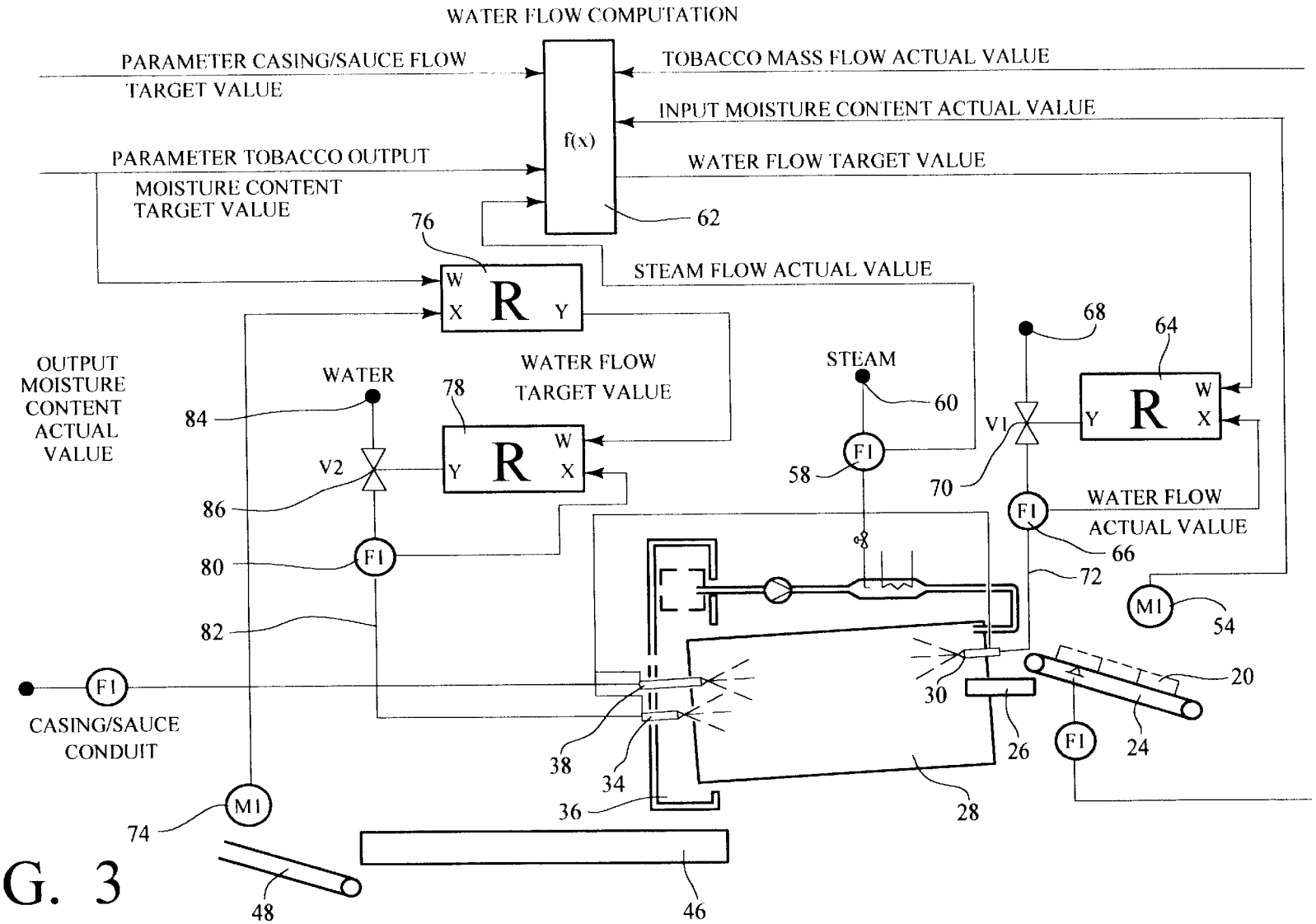
FIG. 3 is a schematic diagram for regulating/controlling the system.

As evident from the schematic regulation diagram as shown in FIG. 3, a series of transducers or measuring value pickups is provided which continuously sense the actual values of the salient process parameters, namely a first transducer 54 for the actual value of the input moisture content, located above the weighing belt 24, and sensing the moisture content of the tobacco slices 20 located on the weighing belt 24 by one of the techniques as usual in the tobacco industry.

The weighing belt 24 establishes the actual value of the tobacco mass flow.

Regulating the tobacco mass flow is done with the aid of the weighing belt 24 by it being caused to run faster or slower, depending on the size of the departure of the tobacco mass flow from the predetermined target value, i.e. a practically constant tobacco mass flow being supplied to the drum 28.

The actual value of the tobacco mass flow supplied to the drum 28 as established by the weighing belt 24 serves in addition for calculating the throughflow of water at the drum input as injected by the nozzle 30, i.e., this throughflow of water depending on the momentary tobacco mass flow.

Provided at the transfer belt 22 between the slicer 16 and the weighing belt 24 is a first photoelectric barrier 50 which "sees" whether a tobacco slice 20 is on the belt 22 or not. If the photoelectric barrier 50 signals a "no slice" alert, the next tobacco slice 20 cut by the slicer 16 is made available via a tipper 53. Should the second photoelectric barrier 51 at the end of the impact belt 22 signal a "no slice" alert, the speed of the impact belt 22 is increased to close the gap between the tobacco slices 20 as a result of which a gapless feed on the weighing belt 24 is assured.

In conclusion, the cutting frequency of the slicer 18 is further dictated by the weighing belt 24, i.e. should the tobacco mass flow drop below the target value, the slicer 18 is moved faster to produce more tobacco slices 20 per unit of time.

A third transducer 58 is connected to a central feeder 60 for the steam, it establishing the momentary actual value of the steam throughflow.

The actual value for the tobacco mass flow, the actual value for the input moisture content and the actual value for the steam throughflow are input into a computer 62 which computes from the momentary values of these actual values, on the one hand, and two process parameters on the other—namely the target value for casing (sauce) throughflow and the target value for output moisture content of the tobacco—the target value for the throughflow of water which is applied to a first controller 64. The actual value for the throughflow of water received by the first controller 64 is the output signal of a fourth transducer 66 connected to a first water infeed 68 for the duplex nozzle 30. The controller 64 processes the target value and actual value for the throughflow of water in the usual way and generates a positioning signal for a water flow valve 70 located in the water feed conduit 72 to the duplex nozzle 30 between the first water infeed 68 and the fourth transducer 66.

From the above parameters the throughflow of water in the infeed region of the drum 28 injected by means of the duplex nozzle 30 is calculated by the following formula;

$$Q_W = \left(\frac{M_2 - M_1}{100\% - M_2} \cdot Q_T - Q_D \cdot A - Q_S \cdot C\right) \cdot B$$

where $Q_w$=throughflow of water $Q_T$=tobacco mass flow $M_2$=output moisture content target value $Q_D$=steam throughflow actual value $M_1$=input moisture content actual value $Q_S$=casing (sauce) amount The factor A contained in this formula is in the range of 0.4 to 1 and serves the purpose of adapting the influence of the steam flow on the water amount in the process and on the system 10, thereby taken into account more particularly the differences in the condensation of steam at the tobacco, a feature dictated by the following influencing variables: drum temperature, tobacco temperature, steam flow and air flow profile in the drum. The factor A can be set on the bases of empirical data when taking into account these parameters.

The value for the factor B is in the range 0.6 to 0.8 and assumes that the computed water flow corresponds to roughly 60 to 80% of total water flow in the process. The remaining water flow, i.e. 20 to 40% of total water flow, serves as the working range for tuning the output moisture content in the tobacco discharge done via the duplex nozzle 34 in the discharge region.

Should a casing (saucing) means be present, as is already included in the formula, it must further be taken into account that the casing (sauce) likewise contains water. The water content of commercially available casing (sauces) is in the region 50% to almost 100% and is taken into account by the factor C, the numerical value on which is between 0.5 and almost 1.

The actual value of the output moisture content of the tobacco is established above the conveyor belt 48 by means of a fifth transducer 74, the output signal of which is applied to a second controller 76 which also receives the target value for the output moisture content of the tobacco, as is evident from FIG. 3.

The second controller 76 processes the two signals in the usual way in accordance with one of the known control mechanisms and generates a target value for the water flow in the discharge region which is applied to a third controller 78 which receives the actual value of the water supply to the duplex nozzle 34 from a sixth transducer 80 located in the water conduit 82 between a second water infeed 84 for the discharge region and the duplex nozzle 34. The third controller 78 activates a flow control valve 86 arranged between the second water infeed 84 and the transducer 80.

In the on-going process the actual values for the tobacco mass flow, steam throughflow and the input moisture content of the tobacco are continuously adapted to the target value for the throughflow of water so that in taking into account the target value for the output moisture content of the tobacco, depending among other things on the subsequent steps in the method and the nature of the tobacco being used, as well as optionally the target value for the casing (sauce) throughflow, the optimum throughflow of water may be computed, from which in turn in the first controller 64 an optimum target value for the water flow is tuned as injected at the inlet of the drum 28 by means of the duplex nozzle 30 onto the tobacco in the drum 28, whereby the steam flow fed to the system is automatically taken into account.

The water amount for the duplex nozzle 34 is determined by a cascade control 76, 78, regulating the output moisture content of the tobacco being finalized by the master controller 78.

The casing (sauce) throughflow is regulated by a separate control loop (not shown).

In a further (likewise not shown) control loop the steam flow injected into the recirculating air passage is set to maintain the temperature of the drum 28 at a predetermined target value.

What is claimed is:

1. A method for regulating the output moisture content of a mass flow of tobacco to a target value from an input moisture content by conditioning in a drum having infeed and outlet regions and having steam throughflow, comprising;

injecting into said infeed region of said drum through a first nozzle a throughflow of water regulated depending on:

said target value for said output moisture content of said tobacco;

an actual value for said tobacco mass flow;

said steam throughflow and said input moisture content of said tobacco;

and further injecting into said outlet region of said drum through a second nozzle a throughflow of water at a target value, said target value of said throughflow of water is computed depending on:

said target value of said output moisture content of said tobacco and an actual value for said output moisture content of said tobacco.

2. The method as set forth in claim 1, wherein said calculated throughflow of water for said second nozzle is further controlled by comparison with said actual value for said injected water amount.

3. The method as set forth in claim 2, wherein said throughflow of water for said second nozzle is controlled by comparing said target and said actual values of said tobacco output moisture content.

4. The method as set forth in claim 1, wherein the computing of said throughflow of water for said first nozzle is done taking into account a casing throughput target value fed to said drum.

5. The method as set forth in claim 4, wherein said throughflow of water in said infeed region of said drum is computed by the following formula:

$$Q_W = \left(\frac{M_2 - M_1}{100\% - M_2} \cdot Q_T - Q_D \cdot A - Q_S \cdot C\right) \cdot B$$

where $Q_W$=said throughflow of water $Q_T$=said tobacco mass flow $M_2$=said output moisture content target value $Q_D$=said steam throughflow actual value $M_1$=said input moisture content actual value $Q_S$=casing amount and wherein factor A being between 0.4 and 1, factor B being between 0.6 and 0.8 and factor C being between 0.5 and 1.0.

6. The method as set forth in claim 1, wherein said tobacco mass flow supplied to said drum is regulated by means of a weighing belt disposed between said drum and a slicer upstream of said drum, said slicer being used to apportion said tobacco in slices.

7. The method as set forth in claim 6, wherein the cutting frequency of said slicer is dictated by said weighing belt.

8. The method as set forth in claim 6, wherein a photoelectric barrier provided between said slicer and said weighing belt activates said slicer.

9. The method as set forth in claim 1, wherein a two-component mixture of water and steam is injected in at least one of said first nozzle and said second nozzle.

10. The method as set forth in claim 1, wherein casing is injected by a nozzle disposed in said discharge region of said drum, said nozzle being configured as a two-component nozzle for a casing and steam mixture.

11. The method as set forth in claim 1, further comprising injecting steam into a recirculating air passage of said drum to control the temperature of said drum.

12. The method as set forth in claim 1, wherein a discharge hood of said drum is heated by a steam heat exchanger.

13. The method as set forth in claim 12, wherein the door of said discharge hood is electrically heated.

* * * * *